US009395646B2

(12) United States Patent
Tarui

(10) Patent No.: US 9,395,646 B2
(45) Date of Patent: Jul. 19, 2016

(54) IMAGE FORMING APPARATUS INCLUDING WASTE TONER CONTAINER

(71) Applicant: KYOCERA Document Solutions Inc., Osaka-shi, Osaka (JP)

(72) Inventor: Yuki Tarui, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/944,141

(22) Filed: Nov. 17, 2015

(65) Prior Publication Data

US 2016/0147176 A1 May 26, 2016

(30) Foreign Application Priority Data

Nov. 21, 2014 (JP) ..... 2014-236154

(51) Int. Cl.

*G03G 15/08* (2006.01)
*G03G 21/10* (2006.01)
*G03G 21/12* (2006.01)

(52) U.S. Cl.

CPC ..... *G03G 15/0831* (2013.01); *G03G 15/0863* (2013.01); *G03G 21/10* (2013.01); *G03G 21/12* (2013.01); *G03G 15/0836* (2013.01); *G03G 15/0862* (2013.01)

(58) Field of Classification Search

CPC ..... G03G 15/0831; G03G 15/0836; G03G 15/0862; G03G 21/10; G03G 21/12

See application file for complete search history.

(56) References Cited

U.S. PATENT DOCUMENTS 4,500,196 A * 2/1985 Shimura ..... G03G 21/005 399/348
4,630,653 A * 12/1986 Kan ..... G03G 21/105 141/256
2009/0252526 A1* 10/2009 Kadowaki ..... G03G 21/12 399/99
2013/0156475 A1* 6/2013 Minemura ..... G03G 21/12 399/360
2013/0330105 A1* 12/2013 Komatsu ..... G03G 15/0832 399/262
2014/0334860 A1* 11/2014 Shima ..... G03G 21/12 399/360

FOREIGN PATENT DOCUMENTS

JP 03101786 A 4/1991

* cited by examiner

*Primary Examiner* — Rodney Bonnette
(74) *Attorney, Agent, or Firm* — Alleman Hall McCoy Russell & Tuttle LLP

(57) ABSTRACT

An image forming apparatus includes a toner container, a mounting portion, an elastic member, a displacement amount detection portion, a stored amount determination portion, and a cushioning member. The elastic member is configured to support the toner container by an elastic force thereof and contract and stretch in accordance with a weight of the toner container. The displacement amount detection portion is configured to detect a displacement amount of the toner container displaced in a gravitational direction when the weight of the toner container increases. The stored amount determination portion is configured to determine an amount of the toner stored in the toner container on the basis of a result of detection by the displacement amount detection portion. The cushioning member is configured to cushion vibration of the toner container in the gravitational direction which vibration occurs due to a change in the weight of the toner container.

13 Claims, 8 Drawing Sheets

IMAGE FORMING APPARATUS INCLUDING WASTE TONER CONTAINER

INCORPORATION BY REFERENCE

This application is based upon and claims the benefit of priority from the corresponding Japanese Patent Application No. 2014-236154 filed on Nov. 21, 2014, the entire contents of which are incorporated herein by reference.

BACKGROUND

The present disclosure relates to an image forming apparatus including a toner container which contains toner.

An image forming apparatus which forms an image on a print sheet by electrophotography, such as a copying machine and a printer, is equipped with a developing device. A developer which includes toner is contained in the developing device. The developing device develops an electrostatic latent image formed on an image carrier such as a photosensitive drum, with the toner included in the developer. The toner image developed on the image carrier is fixed onto a print sheet by a fixing device. The toner that has not been transferred onto the print sheet during the fixation may remain on the image carrier on which the fixation has been performed. Thus, conventionally, a waste toner collection device which removes toner remaining on an image carrier and collects the toner as waste toner has been known.

In such a type of a waste toner collection device, the waste toner removed from the image carrier is received into a waste toner container included in the waste toner collection device. The waste toner container is configured to be mountable to and detachable from an image forming apparatus. When the waste toner container becomes full of the waste toner, the waste toner collection device detects that the waste toner container is full, with a detection sensor such as a weight sensor, and notifies a user that the waste toner container is full. By confirming the notification, the user can recognize timing at which the waste toner container is to be replaced.

SUMMARY

An image forming apparatus according to one aspect of the present disclosure includes a toner container, a mounting portion, an elastic member, a displacement amount detection portion, a stored amount determination portion, and a cushioning member. The toner container has, in an end portion thereof, an opening through which toner can flow in or out. The mounting portion is configured to detachably mount the toner container thereon and guide the toner supplied from outside, through the opening into an interior of the toner container in a state where the toner container is mounted thereon. The elastic member is provided between the toner container and the mounting portion and configured to support the toner container by an elastic force thereof and contract and stretch in accordance with a weight of the toner container. The displacement amount detection portion is configured to detect a displacement amount of the toner container displaced in a gravitational direction when the weight of the toner container increases. The stored amount determination portion is configured to determine an amount of the toner stored in the toner container on the basis of a result of detection by the displacement amount detection portion. The cushioning member is provided between the mounting portion and the toner container and configured to cushion vibration of the toner container in the gravitational direction which vibration occurs due to a change in the weight of the toner container.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, an image forming apparatus 10 according to an embodiment of the present disclosure will be described with reference to the drawings. In the following description, an up-down direction D1 is defined on the basis of a state where the image forming apparatus 10 is installed on a flat plane. A front-rear direction D2 is defined with, as a near side (front surface side), a side from which supply toner bottles 41 and a waste toner bottle 61 are inserted into the image forming apparatus 10. A right-left direction D3 is defined by the image forming apparatus 10 being viewed from the near side (front surface side).

[Image Forming Apparatus]

The image forming apparatus 10 is an apparatus having at least a print function, and is, for example, a color printer. The image forming apparatus 10 prints an image on a print sheet, which is a sheet member, with a developer including toner. Specific examples of the image forming apparatus 10 according to the embodiment of the present disclosure include a printer, a copying machine, a facsimile, and a multifunction peripheral having the functions of these machines. In addition, the image forming apparatus 10 is able to form a color image, but an image forming apparatus of the present disclosure may be configured to be able to form a monochrome image.

Figure 1:
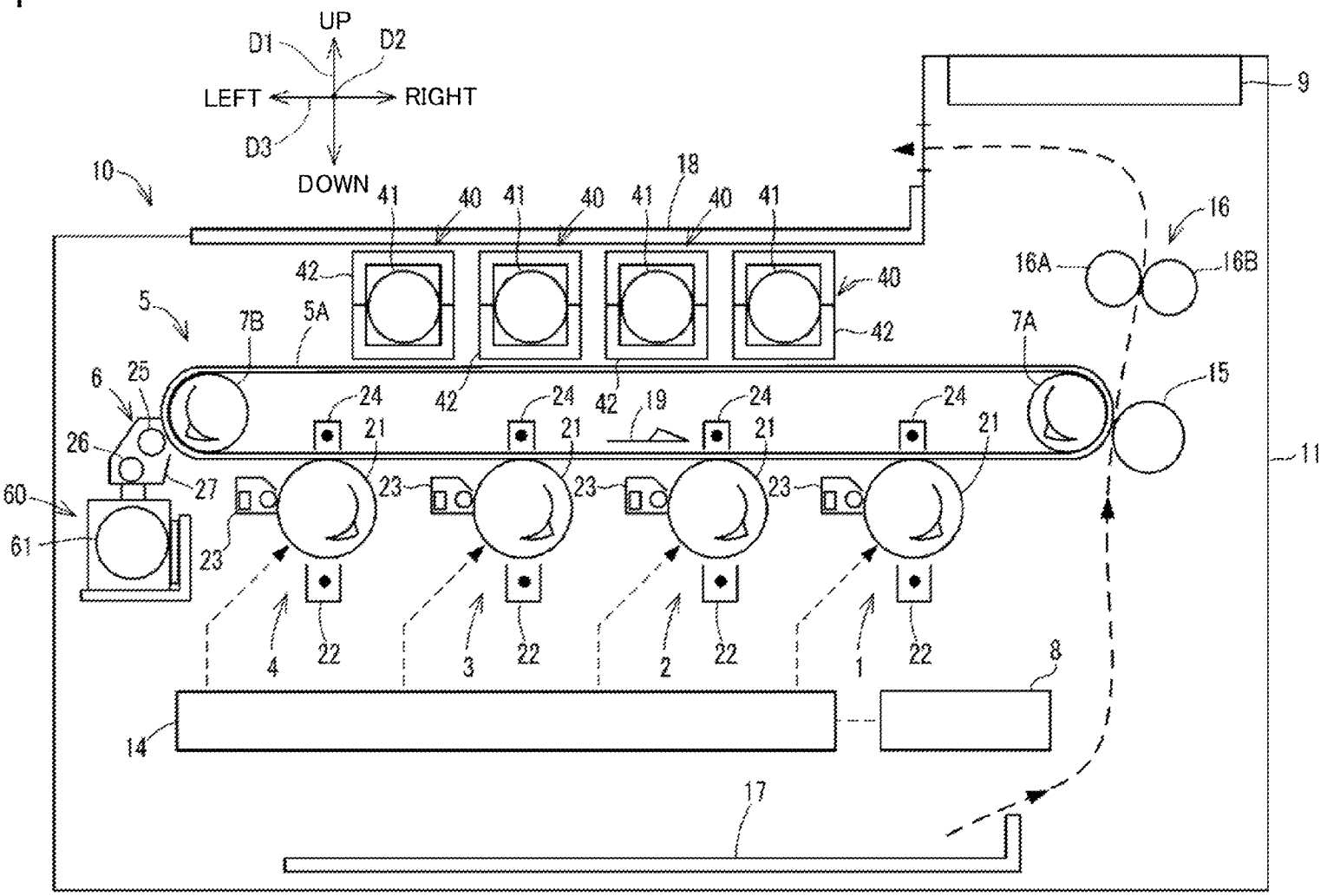
FIG. 1 is a diagram showing an image forming apparatus according to an embodiment of the present disclosure.

As shown in FIG. 1, the image forming apparatus 10 is a so-called tandem-type color image forming apparatus. The image forming apparatus 10 includes: a plurality of image forming portions 1 to 4; an intermediate transfer unit 5; an exposure device 14; a secondary transfer device 15; a fixing device 16; a belt cleaning device 6 (an example of a waste toner collection portion of the present disclosure); toner supply devices 40; an operation display portion 9 including a touch panel, and a liquid crystal display portion, etc.; a control portion 8; a paper feed tray 17; and a paper discharge tray 18. These components are mounted on a housing 11 (an example of an apparatus main body of the present disclosure) which forms an outer frame (not shown), an inner frame, and the like of the image forming apparatus 10.

The image forming portions 1 to 4 form toner images having colors different from each other, on a plurality of aligned photosensitive drums 21, respectively, by so-called electrophotography. The toner images are successively transferred in an overlaid manner onto an intermediate transfer belt 5A that is running (moving). In the example shown in FIG. 1, the image forming portion 1 for black, the image forming portion 2 for yellow, the image forming portion 3 for cyan, and the image forming portion 4 for magenta are arranged in a single line in this order from the downstream side in the moving direction of the intermediate transfer belt 5A (the direction of an arrow 19).

The image forming portions 1 to 4 each include a photosensitive drum 21 which carries a toner image, a charging device 22, a developing device 23 (an example of a developing portion of the present disclosure), and a primary transfer device 24, etc. The surface of the photosensitive drum 21 is charged by the charging device 22, and the charged surface of the photosensitive drum 21 is exposed to light and scanned by the exposure device 14. Thus, an electrostatic latent image is formed on the surface of the photosensitive drum 21. The developing device 23 develops the electrostatic latent image with toner. Then, the toner image on the photosensitive drum 21 is transferred onto the intermediate transfer belt 5A by the primary transfer device 24.

The intermediate transfer unit 5 includes the intermediate transfer belt 5A (an example of an image carrier of the present disclosure), a driving roller 7A, and a driven roller 7B. The intermediate transfer belt 5A carries a toner image composed of toner images having a plurality of colors (four colors in the present embodiment). The intermediate transfer belt 5A is supported by the driving roller 7A and the driven roller 7B such that the intermediate transfer belt 5A can be rotationally driven, whereby the surface of the intermediate transfer belt 5A is movable (can run) while being in contact with the surface of each photosensitive drum 21. When the intermediate transfer belt 5A is rotationally driven, the surface of the intermediate transfer belt 5A passes through between each photosensitive drum 21 and each primary transfer device 24. At this time, the respective toner images of the colors carried on a plurality of the photosensitive drums 21 are successively transferred onto the intermediate transfer belt 5A.

A plurality of the toner supply devices 40 are provided above the intermediate transfer unit 5. In the present embodiment, four toner supply devices 40 corresponding to the respective colors of black, yellow, cyan, and magenta are provided. The toner supply devices 40 will be described later.

The secondary transfer device 15 transfers the toner images transferred on the intermediate transfer belt 5A, onto a print sheet that is conveyed from the paper feed tray 17. The print sheet on which the toner images have been transferred is conveyed to the fixing device 16 by a conveying portion which is not shown. The fixing device 16 includes a heating roller 16A and a pressure roller 16B. The fixing device 16 conveys the print sheet on which the toner images have been transferred, while heating and applying pressure to the print sheet. Thus, the toner images are melted and fixed on the print sheet. The print sheet on which the toner images have been fixed is further conveyed to the downstream side, and is discharged and held in the paper discharge tray 18 disposed above the intermediate transfer unit 5.

The belt cleaning device 6 removes and collects waste toner remaining on the surface of the intermediate transfer belt 5A and supplies the collected waste toner into the interior of the waste toner bottle 61. The belt cleaning device 6 is disposed at the front side of the intermediate transfer unit 5. The belt cleaning device 6 includes a cleaning roller 25 which is a cleaning member, a screw member 26, a toner box 27, and a waste toner receiving portion 60. The cleaning roller 25 is opposed to the driven roller 7B, and the surface of the cleaning roller 25 is in contact with the intermediate transfer belt 5A. The length of the cleaning roller 25 in the front-rear direction D2 is substantially equal to that of the intermediate transfer belt 5A. The cleaning roller 25 is rotatably supported within the toner box 27. The cleaning roller 25 is rotated when a rotational driving force is inputted to a support shaft of the cleaning roller 25.

When being rotated in a state of being in contact with the intermediate transfer belt 5A, the cleaning roller 25 removes the toner that has remained on the surface of the intermediate transfer belt 5A after the transfer by the secondary transfer device 15. Hereinafter, the toner removed by the cleaning roller 25 is referred to as "waste toner". The waste toner is taken and collected into the toner box 27 by the action of gravity or a rotational force of the cleaning roller 25. The waste toner collected in the toner box 27 is conveyed by the screw member 26. A discharge port (not shown) is formed in a bottom surface of the toner box 27 and at a rear end portion side. When the screw member 26 is rotated, the waste toner is conveyed within the toner box 27 toward the discharge port.

The waste toner receiving portion 60 is provided below the toner box 27. When the waste toner has been discharged through the discharge port, the waste toner is guided and stored into the waste toner bottle 61 of the waste toner receiving portion 60. That is, the toner remaining on the surface of the intermediate transfer belt 5A is collected by the belt cleaning device 6 and received as waste toner in the waste toner bottle 61. The waste toner receiving portion 60 will be described later.

[Toner Supply Device]

Figure 2:
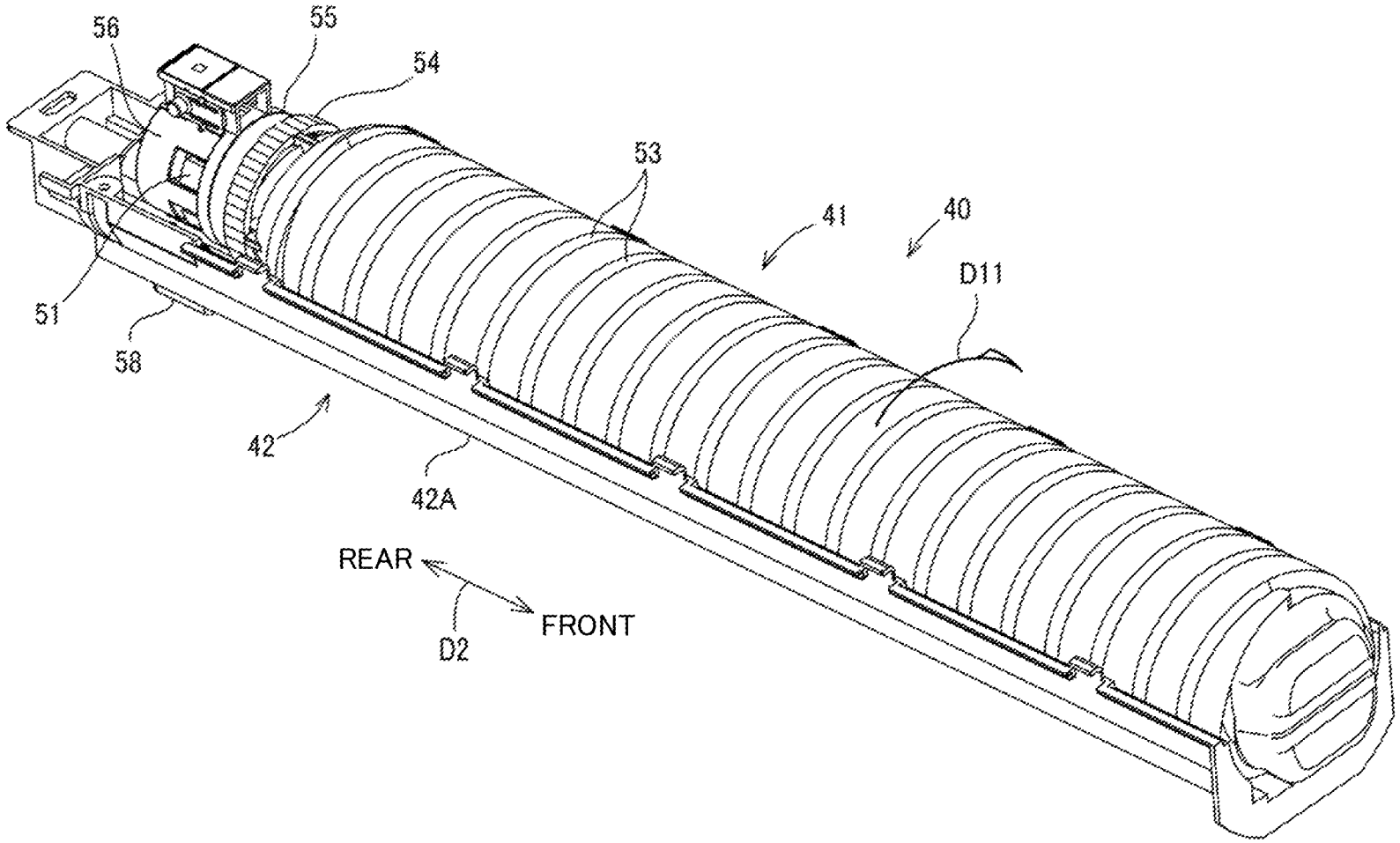
FIG. 2 is a diagram showing a toner supply device included in the image forming apparatus in FIG. 1.

Hereinafter, the toner supply devices 40 will be described with reference to FIG. 2. In the present embodiment, the image forming apparatus 10 includes the plurality of the toner supply devices 40, and the toner supply devices 40 have the same configuration. As shown in FIG. 2, each toner supply device 40 includes the supply toner bottle 41 (an example of a toner supply container of the present disclosure) and a container mounting portion 42 on which the supply toner bottle 41 is mounted. In FIG. 2, on the basis of an attitude in which the toner supply device 40 is mounted on the housing 11, a vertical direction is defined as the up-down direction D1, a direction in which the supply toner bottle 41 is mounted to and detached from the housing 11 (a direction in which the supply toner bottle 41 is inserted into and pulled out from the housing 11) is defined as the front-rear direction D2, and a horizontal direction as viewed from the front surface in the above mounted attitude is defined as the right-left direction D3.

The supply toner bottle 41 serves to additionally supply toner to the developing device 23. As shown in FIG. 2, the supply toner bottle 41 has an opening 51 in an end portion thereof. The supply toner bottle 41 is formed in a shape which is long in the front-rear direction D2. More specifically, the supply toner bottle 41 is formed in a cylindrical shape which is long in the front-rear direction D2. The interior of the supply toner bottle 41 is a receiving space capable of receiving the toner. The toner to be supplied to the developing device 23 is contained within the supply toner bottle 41. The rear side of the supply toner bottle 41 is formed in a tapered shape, and the opening 51 through which the toner flows in or out is provided in the rear end portion of the supply toner bottle 41. The front side of the supply toner bottle 41 is closed. The supply toner bottle 41 is formed from a synthetic resin such as polyethylene terephthalate (PET) resin.

The supply toner bottle 41 has a mountain-like helical projection rib 53 (see FIG. 2) formed on the inner surface thereof. The projection rib 53 projects from the inner surface of the supply toner bottle 41 toward the center of the supply toner bottle 41. The projection rib 53 is formed so as to be integrated with the supply toner bottle 41. Thus, a helical groove appears on the outer circumferential surface of the supply toner bottle 41 and at a position corresponding to the projection rib 53.

The projection rib 53 serves to convey the toner within the supply toner bottle 41 to the opening 51 side. A drive transmission portion 55 is mounted at the opening 51 side of the supply toner bottle 41. The drive transmission portion 55 receives a rotational driving force from a driving source such as a motor, and transmits the rotational driving force to the supply toner bottle 41. The drive transmission portion 55 is fixed to the rear end portion of the supply toner bottle 41. The drive transmission portion 55 is an annular member having a gear 54 formed on the circumferential surface thereof, and has a through hole at a center portion thereof. The opening 51 is inserted in the through hole of the drive transmission portion 55. A support portion 56 is provided at the rear side with respect to the drive transmission portion 55. The support portion 56 is provided on the container mounting portion 42. The opening 51 is inserted in the interior of the support portion 56. In a state where the opening 51 is inserted in the support portion 56, the supply toner bottle 41 is rotatable in the circumferential direction thereof. That is, the support portion 56 rotatably supports the opening 51 side of the supply toner bottle 41. In a state where the supply toner bottle 41 is mounted on the container mounting portion 42, a rotational driving force of a motor 115 (see FIG. 7) or the like is transmitted to the gear 54. Thus, the rotational driving force is transmitted from the drive transmission portion 55 to the supply toner bottle 41, so that the supply toner bottle 41 rotates in a first rotation direction indicated by an arrow D11. That is, the supply toner bottle 41 rotates about a rotation center extending in a longitudinal direction thereof, in a state where the supply toner bottle 41 is able to supply the toner to the developing device 23. When the supply toner bottle 41 rotates as described above, the toner is conveyed to the opening 51 side (rear side) while being pressed by the projection rib 53.

The gear 54 is connected to the motor 115 (see FIG. 7), which is controlled to be driven by a motor driver 110 (see FIG. 7) of the control portion 8, via a drive transmission mechanism which is not shown. When the motor 115 is rotationally driven, the rotational driving force in the first rotation direction is transmitted to the gear 54.

The container mounting portion 42 includes a support base 42A. The support base 42A supports an outer circumferential portion of the lower half of the supply toner bottle 41 and is formed in a shape which is long in the front-rear direction D2. Only the support base 42A is shown in FIG. 2, but the container mounting portion 42 also includes a cover portion (not shown) which covers an outer circumferential portion of the upper half of the supply toner bottle 41. The cover portion is connected to the support base 42A, whereby the container mounting portion 42 supports the supply toner bottle 41 so as to cover the entire outer peripheral portion of the supply toner bottle 41.

The toner supply device 40 has a toner discharge port 58 at the rear side thereof. The toner discharge port 58 serves to discharge the toner contained in the supply toner bottle 41, to the lower outer side, and is provided in the support base 42A of the container mounting portion 42. The toner that has flowed out from the supply toner bottle 41 through the opening 51 moves downward within the support portion 56 to reach the toner discharge port 58 and is conveyed through a conveyance path, which is not shown, to the developing device 23.

[Waste Toner Receiving Portion]

Figure 3:
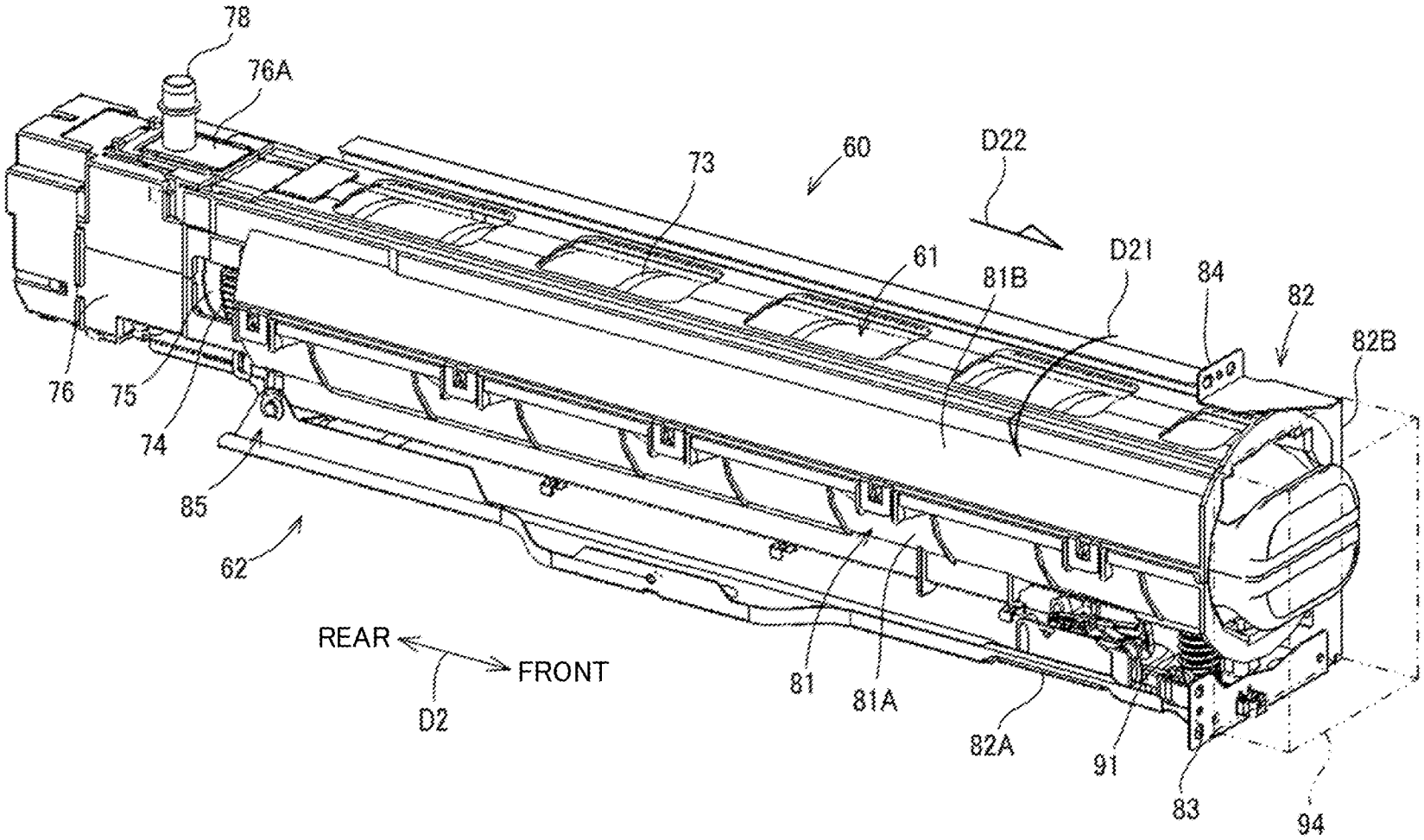
FIG. 3 is a diagram showing a waste toner receiving portion included in the image forming apparatus in FIG. 1.
Figure 4:
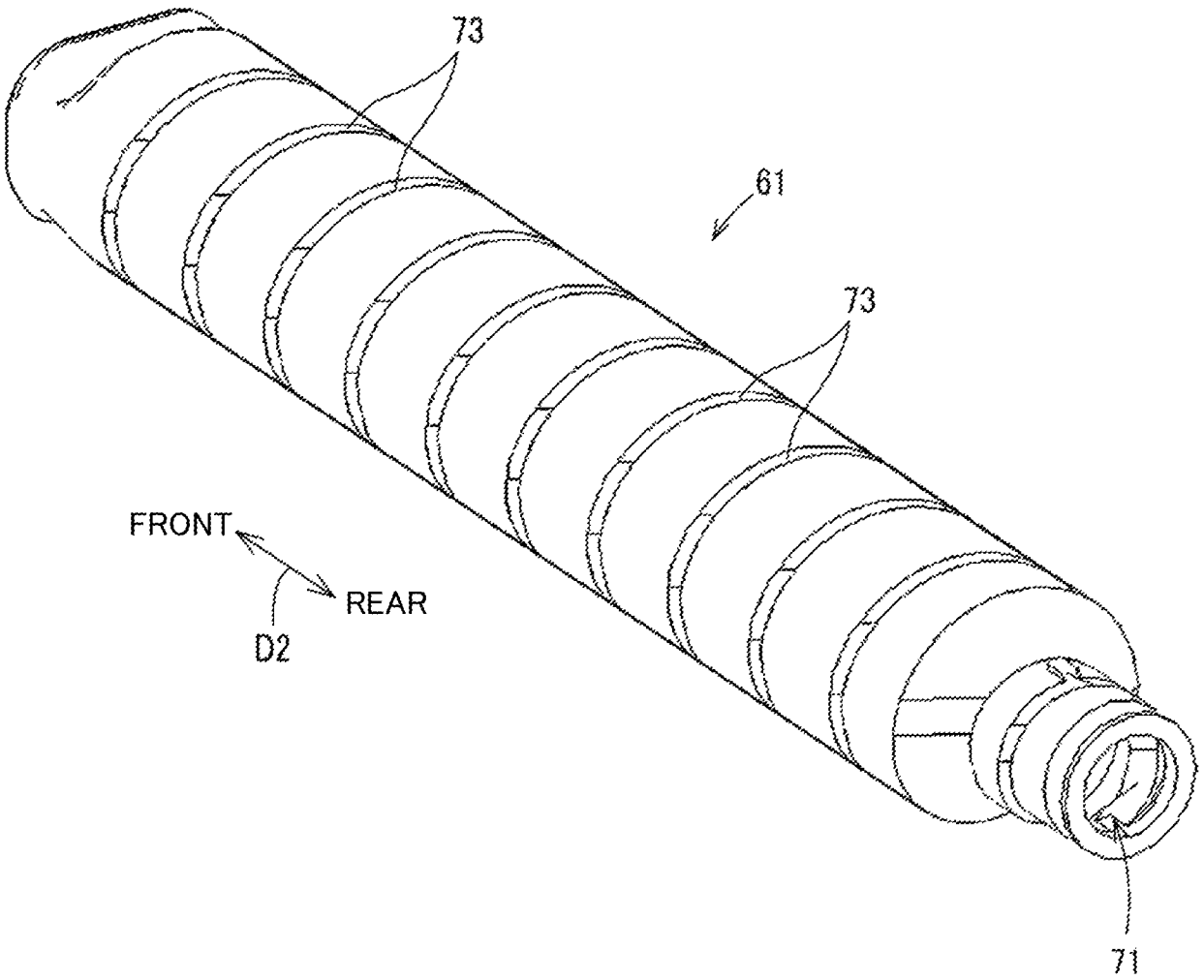
FIG. 4 is a perspective view of a waste toner bottle included in the waste toner receiving portion in FIG. 3.

Hereinafter, the waste toner receiving portion 60 will be described with reference to FIGS. 3 to 6. As shown in FIG. 3, the waste toner receiving portion 60 includes the waste toner bottle 61 (an example of a toner container of the present disclosure) and a container mounting portion 62 (an example of a mounting portion of the present disclosure) on which the waste toner bottle 61 is mounted. In FIGS. 3 to 6, on the basis of an attitude in which the waste toner receiving portion 60 is mounted on the housing 11, a vertical direction is defined as the up-down direction D1, a direction in which the waste toner bottle 61 is mounted to and detached from the housing 11 (a direction in which the waste toner bottle 61 is inserted into and pulled from the housing 11) is defined as the front-rear direction D2, and a horizontal direction as viewed from the front surface in the above mounted attitude is defined as the right-left direction D3.

The waste toner bottle 61 serves to receive the waste toner discharged from the belt cleaning device 6. As shown in FIG. 3, the waste toner bottle 61 is formed in a shape which is long in the front-rear direction D2. In the present embodiment, the waste toner bottle 61 has the same shape as the supply toner bottle 41 included in each toner supply device 40. Therefore, the waste toner bottle 61 has, at an end portion thereof, an opening 71 (see FIG. 4) having the same shape and dimension as the opening 51. The waste toner bottle 61 is formed in a shape which is long in the front-rear direction D2. More specifically, the waste toner bottle 61 is formed in a cylindrical shape which is long in the front-rear direction D2. Since the waste toner bottle 61 has the same shape as the supply toner bottle 41 as described above, the supply toner bottle 41 that is empty can be used as the waste toner bottle 61.

The interior of the waste toner bottle 61 is a receiving space capable of receiving the waste toner. The waste toner removed from the intermediate transfer belt 5A is received within the waste toner bottle 61. The rear side of the waste toner bottle 61 is formed in a tapered shape, and the opening 71 through which the toner flows in or out is provided in the rear end portion of the waste toner bottle 61. The front side of the waste toner bottle 61 is closed. The waste toner bottle 61 is formed from a synthetic resin such as PET resin.

The waste toner bottle 61 has a mountain-like helical projection rib 73 (see FIG. 5) formed on the inner surface thereof. The projection rib 73 is an example of a conveying portion of the present disclosure. By the projection rib 73, the waste toner that has flowed through the opening 71 into the interior of the waste toner bottle 61 can be conveyed in a direction away from the opening 71 (toward the front side). The projection rib 73 projects from the inner surface of the waste toner bottle 61 toward the center of the waste toner bottle 61. The projection rib 73 is formed so as to be integrated with the waste toner bottle 61. Thus, a helical groove appears on the outer circumferential surface of the waste toner bottle 61 and at a position corresponding to the projection rib 73.

The projection rib 73 serves to convey the waste toner within the waste toner bottle 61 in the direction away from the opening 71, that is, from the opening 71 toward the front side. A drive transmission portion 75 having the same configuration as the drive transmission portion 55 of the supply toner bottle 41 is mounted at the opening 71 side of the waste toner bottle 61. In FIG. 3, only a part of the drive transmission portion 75 is shown, and the other part thereof is hidden by the container mounting portion 62. The drive transmission portion 75 is fixed to the rear end portion of the waste toner bottle 61. The drive transmission portion 75 is an annular member having a gear 74 formed on the circumferential surface thereof, and has a through hole at a center portion thereof. The opening 71 is inserted in the through hole of the drive transmission portion 75.

In a state where the waste toner bottle 61 is mounted on the container mounting portion 62, a rotational driving force of the motor 115 (see FIG. 7) or the like is transmitted to the gear 74. At this time, a rotational driving force in a second rotation direction (see an arrow D21) which is opposite to the first rotation direction (see the arrow D11) of the supply toner bottle 41 is transmitted to the gear 74. When such a rotational driving force is transmitted, the waste toner bottle 61 rotates in the second rotation direction indicated by the arrow D21. That is, the waste toner bottle 61 rotates in the second rotation direction (see the arrow D21), which is opposite to the first rotation direction, in a state where the waste toner bottle 61 is mounted on the container mounting portion 62 so that the waste toner can flow into the opening 71. Thus, the waste toner within the waste toner bottle 61 is conveyed in the direction away from the opening 71 (toward the front side) while being pressed by the projection rib 73.

The gear 74 is connected to the motor 115 (see FIG. 7), which is controlled to be driven by the motor driver 110 (see FIG. 7) of the control portion 8, via the drive transmission mechanism which is not shown. When the motor 115 is rotationally driven, the rotational driving force in the second rotation direction is transmitted to the gear 74.

The container mounting portion 62 is configured to allow the waste toner bottle 61 to be mounted thereon and detached therefrom. In a state where the waste toner bottle 61 is mounted on the container mounting portion 62, the container mounting portion 62 can guide the waste toner discharged from the belt cleaning device 6, through the opening 71 into the interior of the waste toner bottle 61. The waste toner bottle 61 can be detached from the container mounting portion 62, and can be mounted to the container mounting portion 62 according to need. Specifically, when the waste toner bottle 61 becomes full of the waste toner or the amount of the waste toner becomes equal to or greater than a predetermined specified amount (full amount), the waste toner bottle 61 is detached by the user. Then, an empty waste toner bottle 61 is mounted by the user.

The container mounting portion 62 includes a toner guide portion 76, a receiving frame 81 (an example of a container receiving portion of the present disclosure), and a support frame 82 (an example of a container support portion of the present disclosure).

The receiving frame 81 includes: a support base 81A which supports an outer circumferential portion of the lower half of the waste toner bottle 61; and an upper cover portion 81B which covers an outer circumferential portion of the upper half of the waste toner bottle 61. The support base 81A is formed in a shape which is long in the front-rear direction D2. A circular-arc-shaped bearing (not shown) is provided on each of both ends of the support base 81A in a longitudinal direction thereof so as to be in contact with the outer circumferential surface of the waste toner bottle 61. The waste toner bottle 61 is supported by the bearings, whereby the waste toner bottle 61 is rotatable on the support base 81A. The upper cover portion 81B is provided at the upper side of the support base 81A and connected to the support base 81A. For the connection of each member, for example, a well-known mechanism such as snap fitting can be used. The lower surface of the upper cover portion 81B is formed as a circular arc surface along the waste toner bottle 61. By the upper cover portion 81B being connected to the support base 81A, a receiving space capable of receiving the waste toner bottle 61 is formed between the upper cover portion 81B and the support base 81A. That is, in a state where the waste toner bottle 61 is received in the receiving space, the receiving frame 81 supports the waste toner bottle 61 such that the waste toner bottle 61 is rotatable about a rotation axis extending in the front-rear direction D2.

A rear end portion of the support base 81A is connected to the support frame 82. A rotation support portion 85 is provided on the rear end portion of the support base 81A. The support base 81A is supported by the rotation support portion 85 so as to be rotatable relative to the support frame 82. That is, the rotation support portion 85 supports the receiving frame 81 including the support base 81A, such that the receiving frame 81 is rotatable relative to the support frame 82.

The toner guide portion 76 is provided on a rear end portion of the container mounting portion 62. The toner guide portion 76 is provided at the rear side with respect to the drive transmission portion 75. The opening 71 is inserted in the interior of the toner guide portion 76. A toner inlet 78 connected to the discharge port of the belt cleaning device 6 is provided on an upper surface 76A of the toner guide portion 76. The toner inlet 78 is a tubular member extending upward from the upper surface 76A. The waste toner flows into the toner inlet 78. A conveyance path (not shown) which guides the toner from the toner inlet 78 to the opening 71 is formed within the toner guide portion 76, and the waste toner is guided through the conveyance path to the opening 71 and flows into the interior of the waste toner bottle 61. A rear end portion of the toner guide portion 76 is engaged with and supported by the inner frame or the like of the housing 11 of the image forming apparatus 10.

The support frame 82 serves to support a bottom portion of the support base 81A of the receiving frame 81 and includes a bottom plate 82A and a side plate 82B (an example of an opposing portion of the present disclosure). The bottom plate 82A is formed in a plate shape which is long in the front-rear direction D2. A bracket 83 for fixing is provided on a front end portion of the bottom plate 82A. The bracket 83 is fixed to the inner frame or the like of the housing 11 by means of a screw or the like.

Figure 6:
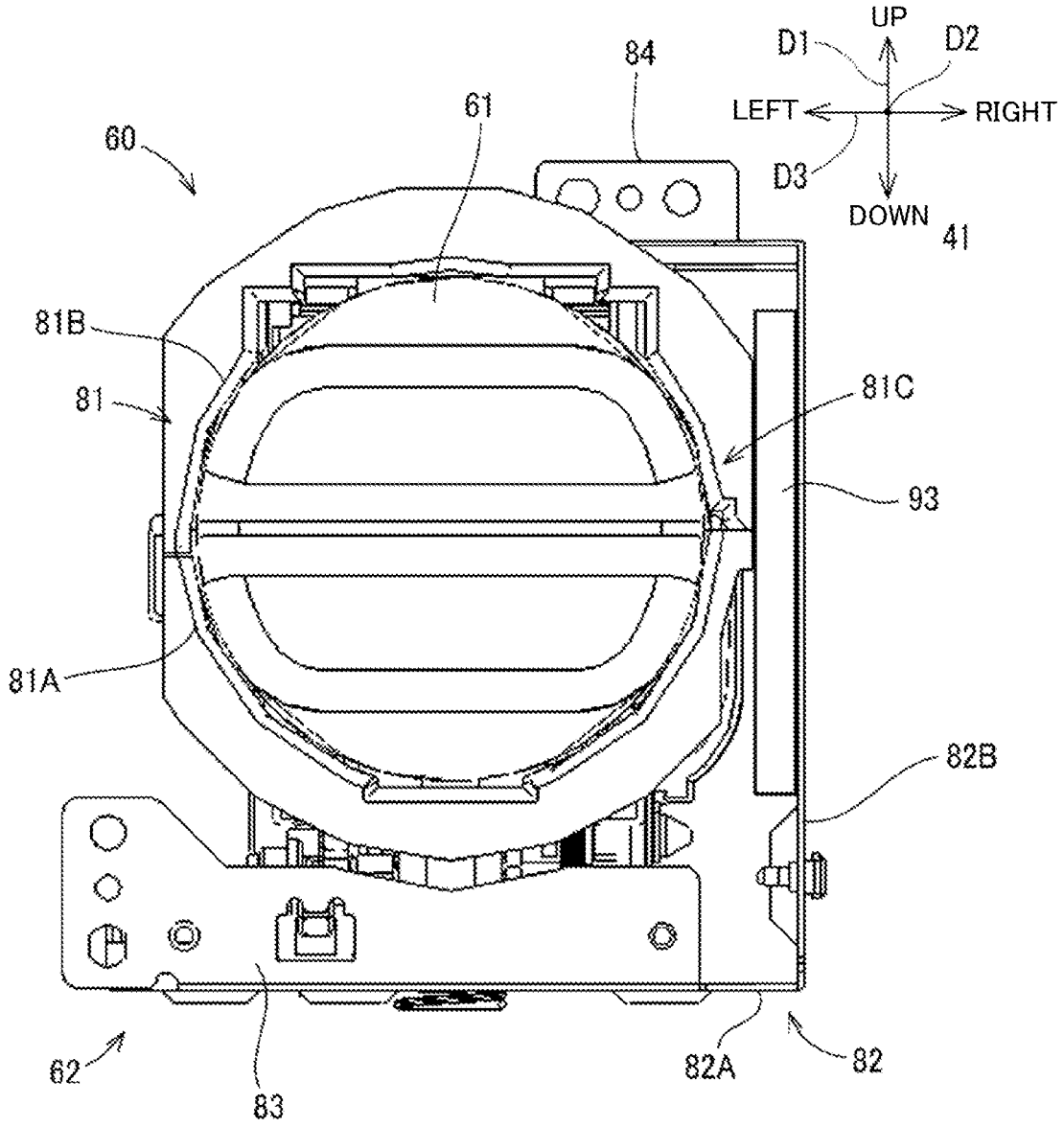
FIG. 6 is a front view of the waste toner receiving portion in FIG. 3.

As shown in FIG. 6, the side plate 82B is provided at a position opposing a right side portion 81C of the receiving frame 81. The side plate 82B is formed of a sheet metal member so as to be integrated with the bottom plate 82A. The side plate 82B is perpendicular to the bottom plate 82A and extends upward from the bottom plate 82A. A bracket 84 is provided on an upper end portion of the side plate 82B. The bracket 84 is fixed to the inner frame or the like of the housing 11 by means of a screw or the like.

As described above, the rotation support portion 85 is provided on the rear end portion of the support base 81A and connected to a rear end portion of the bottom plate 82A. Thus, the receiving frame 81 is rotatable relative to the bottom plate 82A with the rotation support portion 85 as a rotation fulcrum. In the present embodiment, a front end portion of the receiving frame 81 is displaceable relative to the bottom plate 82A in the up-down direction D1 with the rotation support portion 85 as a rotation fulcrum.

Figure 5:
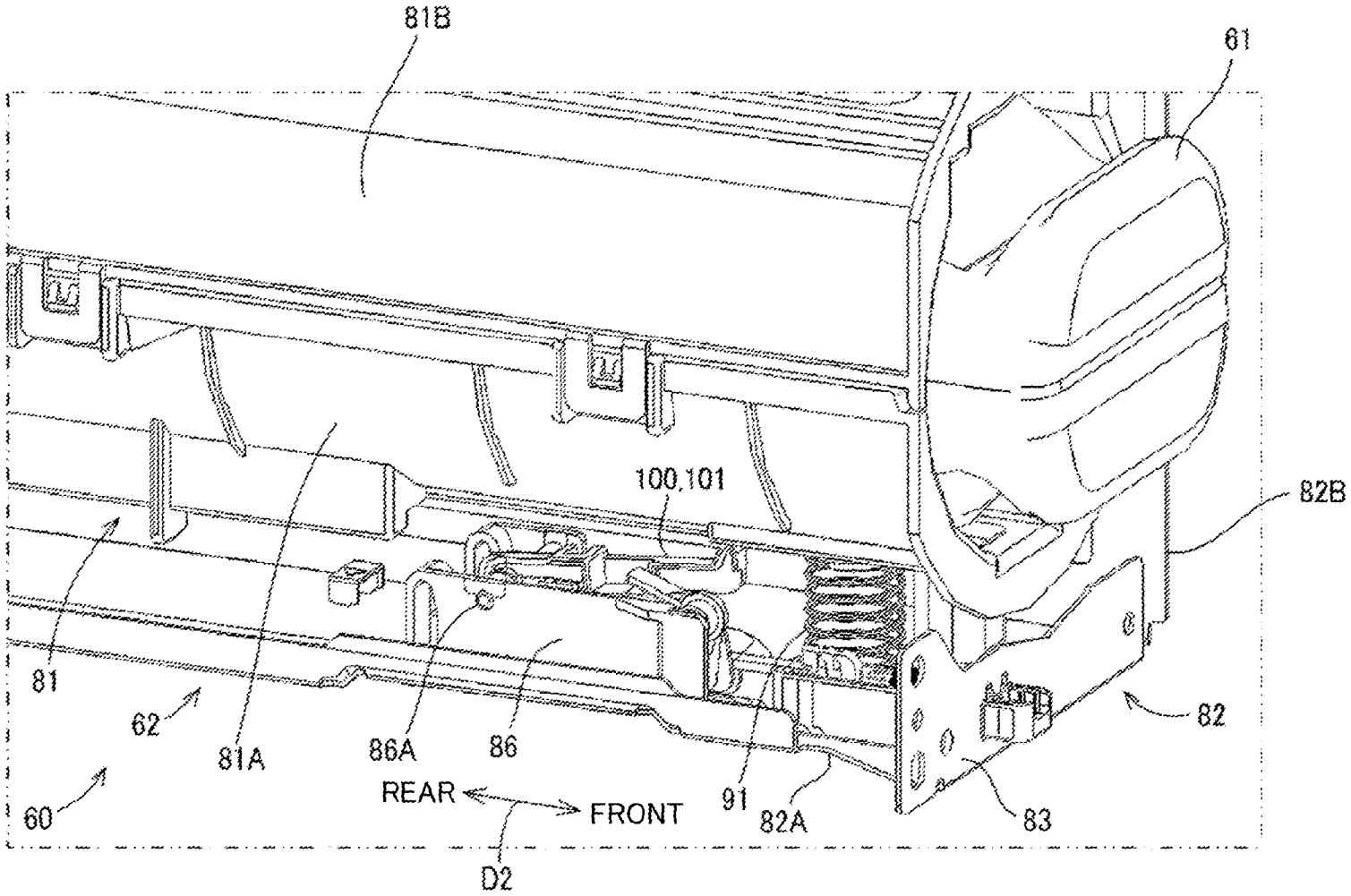
FIG. 5 is a partially enlarged view of the waste toner receiving portion in FIG. 3.

As shown in FIG. 5, the waste toner receiving portion 60 includes a coil spring 91 (an example of an elastic member of the present disclosure). The coil spring 91 is provided between the waste toner bottle 61 and the container mounting portion 62. More specifically, the coil spring 91 is provided between the bottom portion of the support base 81A of the receiving frame 81 and the bottom plate 82A of the support frame 82. The coil spring 91 is disposed on the waste toner bottle 61 and at a position most distant from the opening 71, that is, at the front end side of the container mounting portion 62. The coil spring 91 is mounted at a lower end thereof on the bottom plate 82A and at an upper end thereof on the support base 81A. Thus, in a state where the waste toner bottle 61 is received within the receiving frame 81, the receiving frame 81 is supported on the bottom plate 82A by an elastic force of the coil spring 91 in the up-down direction D1. In other words, the waste toner bottle 61 is elastically supported by the coil spring 91. Thus, if the waste toner flows into the waste toner bottle 61 so that the amount of the waste toner stored therein increases, the coil spring 91 contracts in accordance with the increased weight of the waste toner bottle 61, so that the support base 81A of the receiving frame 81 is displaced downward. In addition, if the amount of the waste toner stored in the waste toner bottle 61 decreases, the coil spring 91 stretches in accordance with the decreased weight of the waste toner bottle 61, so that the support base 81A of the receiving frame 81 is displaced upward. The coil spring 91 is merely an example of the elastic member. Therefore, a member capable of elastically supporting the waste toner bottle 61 can be used instead of the coil spring 91.

As shown in FIG. 6, the waste toner receiving portion 60 also includes a cushioning member 93. The cushioning member 93 is provided on the container mounting portion 62. The cushioning member 93 serves to cushion vibration occurring in the gravitational direction (the up-down direction D1) when the weight of the waste toner bottle 61 changes due to an increase in the amount of the waste toner in the waste toner bottle 61. Specifically, the cushioning member 93 is provided between the side plate 82B and the right side portion 81C of the receiving frame 81. The cushioning member 93 is provided in a state where the cushioning member 93 is in contact with the side plate 82B and the right side portion 81C. In the present embodiment, since the waste toner bottle 61 is supported by the coil spring 91 with respect to the support frame 82, the receiving frame 81 and the waste toner bottle 61 are vibrated in the up-down direction D1 by the coil spring 91 repeatedly contracting and stretching when the weight of the waste toner bottle 61 changes. This vibration is a factor for decreasing the accuracy of detection by a displacement amount detection portion 100 described later. Thus, the cushioning member 93 is provided between the container mounting portion 62 and the waste toner bottle 61. The cushioning member 93 is disposed on front end portions of the side plate 82B and the right side portion 81C. The vibration in the up-down direction D1 is cushioned by the cushioning member 93. The cushioning member 93 suffices to be a member capable of absorbing or alleviating the vibration in the up-down direction D1, and, for example, a member formed of a sponge or an elastic member such as rubber or silicone is conceivable.

Meanwhile, in a conventional waste toner collection device, there is a problem that the waste toner bottle 61 vibrates due to a change in the amount of the waste toner stored in the waste toner bottle 61, so that an output from a sensor which detects the amount of the waste toner becomes unstable. However, in the present embodiment, since the cushioning member 93 is provided on the container mounting portion 62 as described above, when the waste toner is received in the waste toner bottle 61, even if the waste toner bottle 61 is about to vibrate due to a change in the amount of the waste toner stored in the waste toner bottle 61, the cushioning member 93 absorbs and cushions the vibration. Thus, a detection signal outputted from the displacement amount detection portion 100 described later does not become unstable. As a result, the accuracy of a process of determining the stored amount of the waste toner on the basis of the detection signal improves.

As shown in FIG. 5, the waste toner receiving portion 60 includes the displacement amount detection portion 100. The displacement amount detection portion 100 is provided on the container mounting portion 62. The displacement amount detection portion 100 detects a displacement amount of the waste toner bottle 61 displaced in the gravitational direction when the waste toner flows into the waste toner bottle 61 so that the weight of the waste toner bottle 61 increases. Specifically, the displacement amount detection portion 100 includes a movement piece 101 and an optical sensor 102 (an example of a signal output portion of the present disclosure, see FIG. 7). The movement piece 101 and the optical sensor 102 are both provided on the upper surface of the bottom plate 82A. In FIG. 5, the optical sensor 102 is not shown, since the optical sensor 102 is hidden by a bracket 86.

The movement piece 101 moves in the gravitational direction simultaneously with displacement of the waste toner bottle 61 in the gravitational direction (downward). Specifically, the movement piece 101 is an arm-like member extending in the front-rear direction D2, and a rear end portion of the movement piece 101 is rotatably supported by the bracket 86. The bracket 86 is a plate member which stands upward from the bottom plate 82A and extends in the front-rear direction D2. A rotation shaft 86A is provided on the bracket 86, and a rear end of the movement piece 101 is rotatably supported by the rotation shaft 86A. The movement piece 101 is biased upward by a spring member which is not shown, and is in contact with a bottom surface of the support base 81A of the receiving frame 81. The configuration of the movement piece 101 is not limited to the configuration in which the movement piece 101 is biased by the spring member. For example, a front end of the movement piece 101 may be connected to the bottom surface of the support base 81A.

The optical sensor 102 (see FIG. 7) outputs a detection signal corresponding to a position to which the movement piece 101 has moved. The optical sensor 102 is, for example, a transmission type photointerrupter including a light-emitting element (light-emitting portion) and a light-receiving element (light-receiving portion). The light-emitting element is a photodiode or the like which emits light toward a movement path of the movement piece 101. The light-receiving element is a phototransistor or the like which outputs the detection signal upon reception of the light from the light-emitting element. The optical sensor 102 is disposed such that the movement piece 101 can enter a detection space between the light-emitting element and the light-receiving element. The detection signal outputted from the optical sensor 102 is inputted into a signal processing portion 111 of the control portion 8. The control portion 8 determines the amount of the waste toner stored in the waste toner bottle 61, on the basis of the inputted detection signal.

In a state where the movement piece 101 does not enter the detection space, the level of the output signal (detection signal) from the optical sensor 102 becomes a HIGH level. When the movement piece 101 has entered the detection space, the amount of the light reaching the light-receiving element from the light-emitting element decreases in accordance with the degree of the entry. At this time, the level of the output signal outputted from the optical sensor 102 also gradually lowers.

When the movement piece 101 has fully entered the detection space, the level of the output signal from the optical sensor 102 becomes a LOW level.

In the present embodiment, for example, the spring constant and the position of the coil spring 91 and the positions of the movement piece 101 and the optical sensor 102 are set such that the movement piece 101 is prevented from entering the detection space of the optical sensor 102 when the waste toner bottle 61 is empty. In other words, when the waste toner is received into the waste toner bottle 61, the movement piece 101 enters the detection space of the optical sensor 102. In addition, the spring constant and the position of the coil spring 91 and the positions of the movement piece 101 and the optical sensor 102 are set such that the movement piece 101 fully enters the detection space of the optical sensor 102 when the full amount of the waste toner is received in the waste toner bottle 61.

A front cover portion 94 (see FIG. 3) is provided on the support frame 82. The front cover portion 94 is mounted on a front end portion of the support frame 82. In FIG. 3, the front cover portion 94 is shown by an alternate long and two short dashes line. For example, the front cover portion 94 is rotatably supported by a rotation shaft provided on the side plate 82B of the support frame 82. In the present embodiment, the front cover portion 94 opens/closes a front opening of the receiving frame 81 in a state where the waste toner bottle 61 is received in the receiving frame 81.

Figure 7:
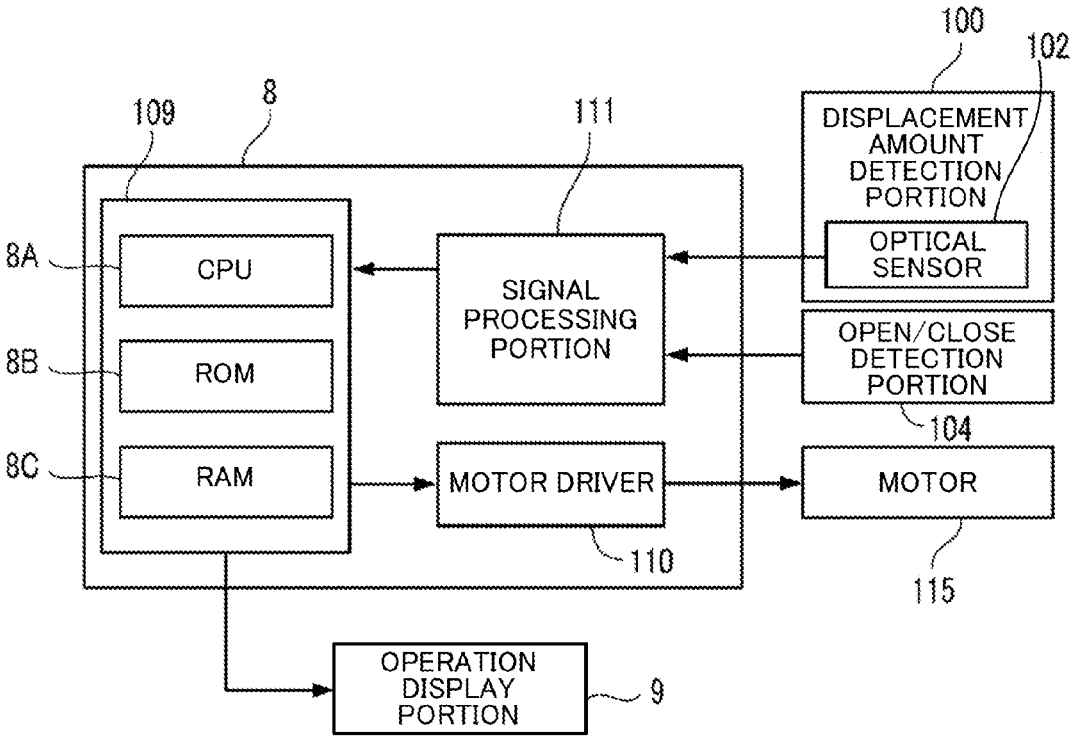
FIG. 7 is a block diagram showing the configuration of a control portion included in the image forming apparatus in FIG. 1.

An open/close detection portion 104 (an example of a reception detection portion of the present disclosure, see FIG. 7) for detecting opening/closing of the front cover portion 94 is provided in the container mounting portion 62. As the open/close detection portion 104, for example, a limit switch or a photointerrupter provided on the side plate 82B, a rotary encoder provided on the rotation shaft of the front cover portion 94, or the like can be used. The open/close detection portion 104 is used for the purpose of determining whether the waste toner bottle 61 is received in the receiving frame 81 of the container mounting portion 62, together with the control portion 8 described later. In other words, the open/close detection portion 104 serves to detect presence/absence of the waste toner bottle 61 in the container mounting portion 62. When the waste toner bottle 61 is mounted to the container mounting portion 62 and then the front cover portion 94 is brought from an open attitude into a closed attitude, the open/close detection portion 104 operates, and a signal indicating that the front cover portion 94 has been closed is outputted to the signal processing portion 111 of the control portion 8. Upon reception of the signal, the control portion 8 determines that the waste toner bottle 61 is received in the receiving frame 81. Here, the open attitude is an attitude taken when the front cover portion 94 is separated from the front opening of the receiving frame 81 to open the front opening, and the closed attitude is an attitude taken when the front cover portion 94 closes the front opening of the receiving frame 81.

A configuration may be used in which presence/absence of the waste toner bottle 61 received in the receiving frame 81 is directly detected by using a reflection type optical sensor, a magnetic sensor, or the like instead of the open/close detection portion 104.

[Control Portion 8]

The control portion 8 centrally controls the image forming apparatus 10. As shown in FIG. 7, the control portion 8 includes a calculation portion 109 which includes a CPU 8A, a ROM 8B, and a RAM 8C, the motor driver 110, and the signal processing portion 111, etc. The calculation portion 109 executes various processes with the CPU 8A according to a predetermined program stored in the ROM 8B. Specifically, the calculation portion 109 performs, for example, a process of determining the amount of the waste toner stored in the waste toner bottle 61 on the basis of a result of detection by the displacement amount detection portion 100, a process of displaying the stored amount of the waste toner on the display portion of the operation display portion 9, and a process of determining whether the waste toner bottle 61 in the container mounting portion 62 has been replaced. Such a calculation portion 109 is an example of a stored amount determination portion and a replacement determination portion of the present disclosure.

The motor driver 110 and the signal processing portion 111 are composed of, for example, an electronic circuit such as an integrated circuit (ASIC), an internal memory, or the like. For example, the motor driver 110 and the signal processing portion 111 may be realized by a predetermined program being executed by the CPU 8A.

The motor driver 110 is electrically connected to the motor 115. The motor driver 110 controls drive of the motor 115 on the basis of an instruction signal from the calculation portion 109. Thus, a rotational driving force in the first rotation direction and a rotational driving force in the second rotation direction are transmitted to the gear 54 and the gear 74, respectively, via the drive transmission mechanism which is not shown.

The signal processing portion 111 converts an inputted signal into a signal which can be processed by the calculation portion 109. Specifically, the signal processing portion 111 converts the detection signal inputted from the optical sensor 102, into a signal corresponding to the amount of the waste toner stored in the waste toner bottle 61, and outputs the signal to the calculation portion 109. In the ROM 8B of the calculation portion 109, a look-up table is stored in which the signal level of an inputted detection signal is associated with information indicating a stored amount corresponding to the signal level. The calculation portion 109 that has received the signal refers to the look-up table and determines the stored amount corresponding to the detection signal. In this case, the calculation portion 109 outputs, to the liquid crystal display portion of the operation display portion 9, information indicating the determined stored amount. As the information indicating the stored amount, in the present embodiment, the calculation portion 109 displays and outputs, on the liquid crystal display portion, an indicator which is segmented with a 10-level scale which can indicate changes in the stored amount from an empty state of the waste toner bottle 61 to a full state of the waste toner bottle 61.

The signal processing portion 111 relays the signal inputted from the open/close detection portion 104, and outputs the signal to the calculation portion 109. Upon reception of the signal, the calculation portion 109 determines an open/closed state of the front cover portion 94.

Figure 8:
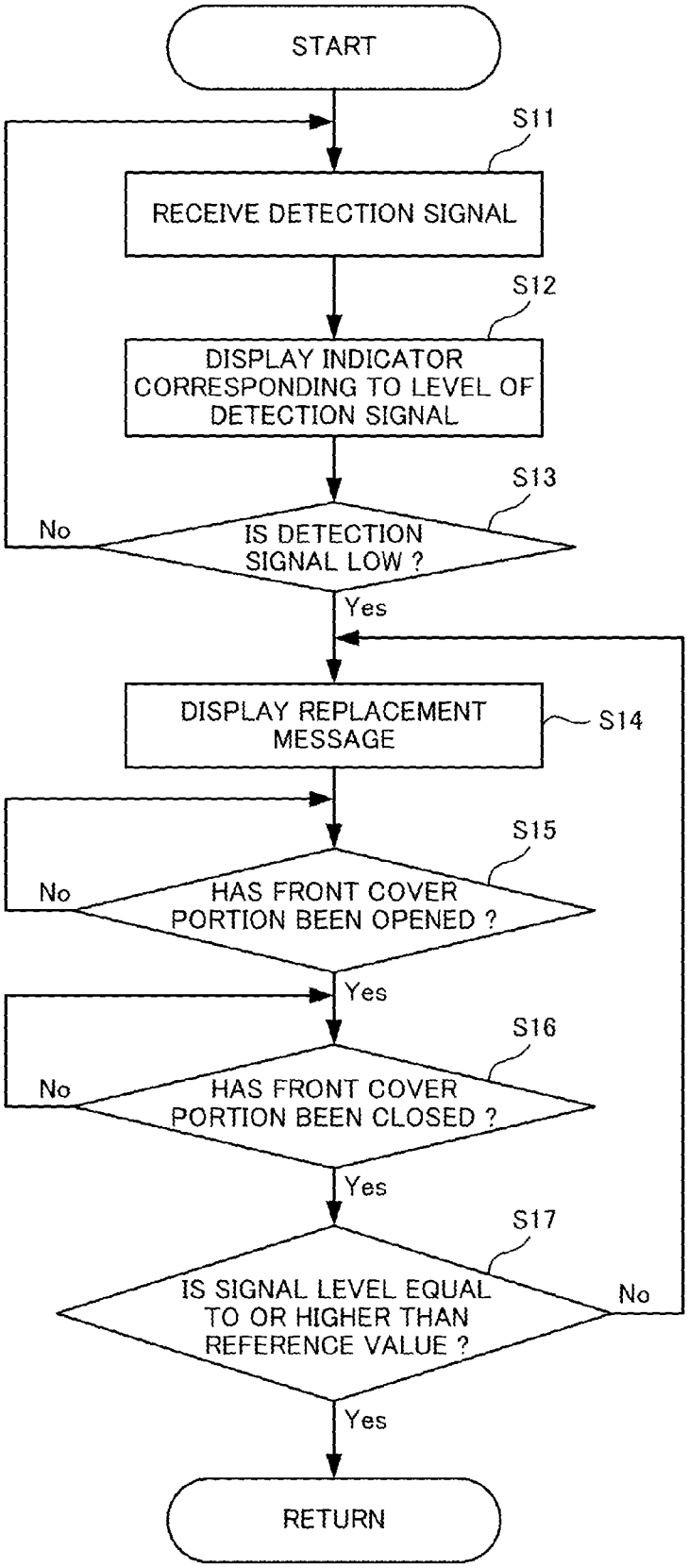
FIG. 8 is a flowchart showing a procedure of processes executed by the control portion shown in FIG. 7.

Next, various processes executed by the control portion 8 will be described with reference to a flowchart in FIG. 8. In FIG. 8, S11, S12 . . . represent process procedure (step) numbers. A process in each step is performed by the control portion 8, more specifically, by the CPU 8A of the calculation portion 109 executing a program within the ROM 8B.

The control portion 8 acquires the detection signal inputted from the optical sensor 102 into the signal processing portion 111 (S11). The control portion 8 outputs, to the operation display portion 9, an indicator corresponding to the level of the detection signal, to cause the indicator to be displayed on the liquid crystal display portion (S12). Accordingly, an indicator indicating the amount of the waste toner stored in the waste toner bottle 61 is displayed on the liquid crystal display portion of the operation display portion 9. For example, if the level of the detection signal is the HIGH level, an indicator indicating that the stored amount of the waste toner is zero, that is, an indicator indicating no scale display, is displayed. In addition, if the level of the detection signal indicates that the stored amount is half the full amount, an indicator in which half of the ten-level scale is in a lighting color is displayed. Moreover, if the level of the detection signal is the LOW level, an indicator indicating that the stored amount of the waste toner is the full amount, that is, an indicator in which the entire scale is in the lighting color, is displayed.

In the next step S13, the control portion 8 determines whether the level of the detection signal is the LOW level. If the level of the detection signal is the LOW level, since the amount of the waste toner stored in the waste toner bottle 61 is the full amount, the determination process is a process of determining whether the amount of the waste toner stored in the waste toner bottle 61 is the full amount. If it is determined in step S13 that the level of the detection signal is the LOW level, the control portion 8 displays, on the liquid crystal display portion of the operation display portion 9, a replacement message which prompts the user to replace the waste toner bottle 61 (S14).

When the user has confirmed the replacement message, the user replaces the mounted waste toner bottle 61 that is full, with an empty waste toner bottle 61 for replacement. At this time, a front panel (not shown) of the image forming apparatus 10 is opened, then the front cover portion 94 on the support frame 82 is opened to open the front opening of the receiving frame 81. Then, the full waste toner bottle 61 is taken out, and the empty waste toner bottle 61 for replacement is inserted into the receiving frame 81. Thereafter, the front cover portion 94 is closed. In the present embodiment, when the replacement message has been displayed, attention is paid to the above replacement operation being performed by the user, and it is determined whether the waste toner bottle 61 has been replaced, on the basis of: the detection result acquired from the open/close detection portion 104 when the replacement is performed; and the amount of the waste toner stored in the waste toner bottle 61.

Specifically, in the next step S15, the control portion 8 determines whether the front cover portion 94 has been brought from the closed attitude into the open attitude, on the basis of the signal from the open/close detection portion 104. That is, it is determined whether the front cover portion 94 has been opened. In the present embodiment, as described above, when the front cover portion 94 is opened, the control portion 8 determines that the waste toner bottle 61 has been pulled out from the receiving frame 81 and is not present in the container mounting portion 62 (absence of the waste toner bottle 61). Subsequently, in step S16, the control portion 8 determines whether the front cover portion 94 has been brought from the open attitude into the closed attitude, on the basis of the signal from the open/close detection portion 104. That is, it is determined whether the front cover portion 94 has been closed. In the present embodiment, as described above, when the front cover portion 94 is closed, the control portion 8 determines that the waste toner bottle 61 has been inserted into the receiving frame 81 and is present in the container mounting portion 62 (presence of the waste toner bottle 61). Here, if a time period equal to or longer than a predetermined time period required for the replacement has elapsed after the front cover portion 94 is opened before the front cover portion 94 is closed, an error message may be displayed, or the replacement message may be displayed again.

In the next step S17, the control portion 8 acquires the detection signal and determines whether the signal level of the detection signal is equal to or higher than a predetermined reference value. This determination is a process for determining whether the amount of the waste toner stored in the waste toner bottle 61 is equal to or less than a predetermined reference amount. Here, for example, the reference value is preferably a signal level (e.g., the HIGH level) indicating that the waste toner bottle 61 is empty. In this case, the reference amount is zero. Alternatively, a signal level other than the LOW level indicating that the waste toner bottle 61 is full may be used as the reference value. In this case, any amount other than the full amount is the reference amount. If the signal level is equal to or higher than the reference value, it means that a space capable of receiving the waste toner is present in the waste toner bottle 61.

If the signal level of the detection signal is equal to or higher than the reference value, the control portion 8 determines that the waste toner bottle 61 has been replaced. In this case, the control portion 8 repeats the processes according to the procedure of step S11 and the subsequent steps. On the other hand, if the signal level of the detection signal is less than the reference value, the control portion 8 determines that the waste toner bottle 61 has not been replaced. In this case, the control portion 8 returns to step S14 and performs the process of displaying the replacement message again.

Since the processes according to the flowchart shown in FIG. 8 are performed by the control portion 8 as described above, it can be assuredly determined whether the replacement operation has been performed after the replacement message is displayed, that is, whether the waste toner bottle 61 has been replaced.

In the above-described embodiment, the transmission type photointerrupter is exemplified as the optical sensor 102 of the displacement amount detection portion 100, but a reflection type photoreflector may be used as the optical sensor 102. In the case where the photoreflector is used, a signal having a signal level opposite to that in the case with the photointerrupter is outputted, and thus the criterion for each process by the control portion 8 is changed in accordance with the signal level.

In the above-described embodiment, the configuration of including the plurality of toner supply devices 40 is illustrated. However, in the case where, for example, the toner supply device 40 for black toner among the plurality of toner supply devices 40 is formed so as to have a capacity larger than that of each of the other supply toner bottles 41, the waste toner bottle 61 is preferably formed in the same shape as the supply toner bottle 41 for black toner. In this case, by using, as the waste toner bottle 61, the supply toner bottle 41 for black toner that is empty, timing at which the waste toner bottle 61 is to be replaced can be delayed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a toner container having, in an end portion thereof, an opening through which toner can flow in or out;

a mounting portion configured to detachably mount the toner container thereon and guide the toner supplied from outside, through the opening into an interior of the toner container in a state where the toner container is mounted thereon;

an elastic member provided between the toner container and the mounting portion and configured to support the toner container by an elastic force thereof and contract and stretch in accordance with a weight of the toner container;

a displacement amount detection portion configured to detect a displacement amount of the toner container displaced in a gravitational direction when the weight of the toner container increases;

a stored amount determination portion configured to determine an amount of the toner stored in the toner container on the basis of a result of detection by the displacement amount detection portion; and a cushioning member provided between the mounting portion and the toner container and configured to cushion vibration of the toner container in the gravitational direction which vibration occurs due to a change in the weight of the toner container.

2. The image forming apparatus according to claim 1, wherein the toner container is formed in a shape which is long in one direction, and the opening is provided in an end portion of the toner container in a longitudinal direction of the tonner container, the mounting portion includes: a container receiving portion configured to receive the toner container such that the toner container is rotatable about a rotational axis extending in the longitudinal direction; and a container support portion configured to support a bottom portion of the container receiving portion, and the elastic member is provided between the bottom portion of the container receiving portion and the container support portion.

3. The image forming apparatus according to claim 2, wherein the container support portion includes an opposing portion opposing a side portion of the container receiving portion, and the cushioning member is provided between the opposing portion and the side portion and is in contact with the opposing portion and the side portion.

4. The image forming apparatus according to claim 2, further comprising:

a reception detection portion configured to detect presence/absence of the toner container in the container receiving portion; and a replacement determination portion configured to determine whether the toner container received in the container receiving portion has been replaced with the toner container that is empty, on the basis of the stored amount determined by the stored amount determination portion and a result of detection by the reception detection portion.

5. The image forming apparatus according to claim 4, wherein if the result of detection by the reception detection portion changes from absence of the toner container to presence of the toner container and then the stored amount determination portion determines that the stored amount of the toner container is equal to or less than a predetermined reference amount, the replacement determination portion determines that the toner container has been replaced with the toner container that is empty.

6. The image forming apparatus according to claim 1, wherein the elastic member is provided on the toner container and at a position most distant from the opening.

7. The image forming apparatus according to claim 1, wherein the displacement amount detection portion includes: a movement piece configured to move in the gravitational direction simultaneously with displacement of the toner container in the gravitational direction; and a signal output portion configured to output a detection signal corresponding to a position to which the movement piece has moved.

8. The image forming apparatus according to claim 7, wherein the signal output portion includes: a light-emitting portion configured to emit light toward a movement path of the movement piece; and a light-receiving portion configured to output the detection signal upon reception of the light from the light-emitting portion.

9. The image forming apparatus according to claim 1, further comprising a waste toner collection portion configured to remove and collect waste toner remaining on a surface of an image carrier and supply the collected waste toner through the opening of the toner container into the interior of the toner container.

10. The image forming apparatus according to claim 1, further comprising a conveying portion configured to convey the toner supplied through the opening into the interior of the toner container, in a direction away from the opening.

11. The image forming apparatus according to claim 10, wherein the toner container is formed in a cylindrical shape which is long in one direction, and the conveying portion is a helical projection rib formed on an inner surface of the toner container.

12. The image forming apparatus according to claim 11, further comprising:

a developing portion configured to form a toner image on a surface of an image carrier; and a toner supply container, provided detachably on an apparatus main body, for supplying toner used in the developing portion to the developing portion, wherein the toner container is the toner supply container that is empty.

13. The image forming apparatus according to claim 12, wherein in a state where the toner supply container is able to supply the toner to the developing portion, the toner supply container is rotated in a first rotation direction in which the toner is movable to the opening, and in a state where the toner container is mounted on the mounting portion so that the toner can flow into the toner container, the toner container is rotated in a second rotation direction opposite to the first rotation direction.

* * * * *